United States Patent [19]

Varnum et al.

[11] Patent Number: 4,484,616

[45] Date of Patent: Nov. 27, 1984

[54] PROCESS FOR PREPARING SAND CORES AND MOLDS

[75] Inventors: Nancy C. Varnum, Kingsville, Mo.; John F. Kraemer, Terre Haute, Ind.

[73] Assignee: International Minerals & Chemical Corp., Terre Haute, Ind.

[21] Appl. No.: 342,307

[22] Filed: Jan. 25, 1982

[51] Int. Cl.[3] ..... B22C 1/00; B22C 1/16

[52] U.S. Cl. ..... 164/520; 106/38.5 R

[58] Field of Search ..... 106/38.23, 38.5 R, 38.7; 164/16, 520

[56] References Cited

U.S. PATENT DOCUMENTS

| | | | |
|---|---|---|---|
| 2,875,073 | 2/1959 | Gogek | 106/38.5 R |
| 2,884,412 | 4/1959 | Neukom | 260/233.5 |
| 2,977,236 | 3/1961 | Neukom | 106/38.5 |
| 3,146,113 | 8/1964 | Middleton | 106/38.23 |
| 3,227,564 | 1/1966 | Standen | 106/38.7 |
| 3,316,106 | 4/1967 | Montague et al. | 106/58 |

FOREIGN PATENT DOCUMENTS

| | | | |
|---|---|---|---|
| 0148774 | 9/1948 | Australia | 106/38.5 R |
| 0339091 | 12/1977 | U.S.S.R. | 164/521 |

OTHER PUBLICATIONS

Anon., Technical Bulletin 2-A, Delta Oil Products Corporation.

Houser, K. E., Foundry, Sep. 1970, Progress in Core-making.

*Primary Examiner*—Kuang Y. Lin

*Assistant Examiner*—Richard K. Seidel

*Attorney, Agent, or Firm*—Robert H. Dewey

[57] ABSTRACT

An improved process for preparing foundry cores and molds using a foundry aggregate and a binder therefor wherein the aggregate is mixed with an aqueous suspension of cereal flour and then with a core oil, the improvement comprising mixing the aggregate with phosphoric acid or sulfuric acid before mixing with the aqueous suspension of the cereal flour.

7 Claims, No Drawings

PROCESS FOR PREPARING SAND CORES AND MOLDS

This invention relates to an improved process for preparing sand cores and molds. In a particular aspect, this invention relates to an improved process especially useful with alkaline aggregate.

Foundry cores and molds, useful for preparing metal articles of various shapes and sizes, are prepared from a foundry aggregate, such as silica sand, and a binder therefor. A variety of binders have been used, the selection of which depends on a number of factors, such as speed of set, tensile strength, etc. One group of binders is known as core oils. These are conventional drying oils, e.g. linseed oil, with a metallic drier or catalyst added. Such core oils are often mixed with cereal, such as corn flour or cornstarch, and water. A binder such as this is mixed with the aggregate, placed in the core box or mold and heated to 400°–450° F. for about an hour during which time the drying oil polymerizes and binds the aggregate.

Core oils usually form a strong bond with silica sand, but with alkaline sand, such as olivine, the bond is weaker and yields a less satisfactory core. Previously, in order to overcome the adverse effect of alkalinity, acid salts have been mixed with the sand to yield a core of improved strength. Ammonium nitrate has been so used and it has the advantage of acting as an oxidizing agent to promote drying the oil. Although ammonium nitrate has been successful in this use, there exists a need for alternate methods of utilizing alkaline sands, such as olivine, with core oils.

SUMMARY OF THE INVENTION

It is an object of this invention to provide an improved process for preparing sand cores and molds for foundry operations.

It is another object of this invention to provide an improved process for preparing sand cores and molds using alkaline foundry aggregates.

Other objects of this invention will be apparent to those skilled in the art from the disclosure herein.

It is the discovery of this invention to provide an improved process for preparing cores and molds for foundry use using a foundry aggregate and a core oil as a binder. The improved process comprises mixing the aggregate with orthophosphoric acid or sulfuric acid, coating the treated aggregate with cereal flour and water, as is known, then finally coating the aggregate with a core oil and delivering this aggregate-binder composition to a core box or molding box and heating it to effect polymerization of the binder.

DETAILED DISCUSSION

The treatment of foundry aggregate with cereal flour, water and a core oil prior to delivery to a core box or molding box is conventional in the foundry art. It is the improvement of this invention to treat the aggregate with sulfuric or, preferably, orthophosphoric acid before contacting the aggregate with the cereal flour-water mixture. The improvement is particularly useful with alkaline sands, especially with olivine sand.

The amount of acid used varies somewhat with the Acid Demand Value (the determination of which is within the skill of the artisan) of the foundry aggregate but in general it will be in the range of from about 0.05 to 5.0% based on the weight of the aggregate, usually 0.25 to 1.0%.

Olivine sand is preferred for use with the improved core oil of this invention. It is a natural mineral consisting of a solid solution rich in magnesium orthosilicate (Fosterite) with a minor amount of ferric orthosilicate (Fayalite). Olivine is a major component of dunite rock. Peridotite is another olivine-bearing rock. Typically, olivine has a composition falling within the following general ranges:

| | |
|---|---|
| MgO | 40–52% by weight |
| $SiO_2$ | 35–45% by weight |
| FeO | 6.5–10% by weight |
| $Al_2O_3$, $K_2O$, $Na_2O$ | Trace |

Any olivine falling within the above ranges is suitable for the practice of this invention.

The practice of this invention is not limited to olivine. The step of treating the aggregate is also useful with other alkaline foundry aggregates including but not limited to chromite, zircon, staurolite and aluminum silicate.

Core oils are well known in the art. Any of the known core oils are suitable for the practice of this invention. Generally, any unsaturated oil which polymerizes by reaction with oxygen, i.e. any drying oil, is suitable for use as a core oil. A discussion of core oils used in foundry practice is given by K. E. Houser, Foundry, September 1970, published by the Penton Publishing Company, Cleveland, Ohio 44113. Also, Technical Bulletin 2-A "Core Oil", Delta Oil Products Corporation, Milwaukee, Wis. 53209 is another useful reference. Generally, a metal drier (or catalyst) is used with the core oil and often is included in the formulation. Typical driers include compounds of iron, lead, etc. These driers are conventional in the art and form no part of the invention.

The invention will be better understood with reference to the following examples. It is understood that the examples are intended only to illustrate the invention. It is not intended that the invention be limited thereby.

EXAMPLE 1

North Carolina olivine 1500 g was coated with 15 g 85% orthophosphoric acid for 2 minutes using a Hobart N-50 mixer at speed 2. Then, corn flour 15 g was coated on the sand for 30 seconds at speed 2, followed by water 30 g for 2 minutes at speed 2, and finally core oil 15 g. The coated sand was rammed in "dog bone" tensile specimen molds, carefully removed from the molds onto a metal sheet, and placed in a circulating air oven at 200° C. for the time indicated. A second group of tensile cores were prepared by the same method except that phosphoric acid was omitted for comparison. The results are as follows:

| | Tensile Strength, psi | |
|---|---|---|
| Bake Time | With $H_3PO_4$ | Without $H_3PO_4$ |
| 0.5 hrs | 103 | 58 |
| 1 hr | 115 | 82 |
| 1.5 hrs | 165 | 77 |
| 2 hrs | 168 | 65 |

The core oil used in the above experiment was linseed oil, 40% diluted with petroleum hydrocarbon, 48%, and kerosene, 12%, to which was added 0.5% of 12% iron naphthenate as a catalyst.

EXAMPLE 2

The experiment of Example 1 was repeated in all essential details except that concentrated sulfuric acid 3.75 g was substituted for the phosphoric acid. A control without acid had a tensile strength of 68 psi after baking one hour at 200° C. and the sample treated with the sulfuric acid had a tensile strength of 125 psi.

We claim:

1. A process for preparing foundry cores and molds using an alkaline foundry aggregate and a binder therefor consisting of the steps of (a) mixing the aggregate with orthophosphoric or sulfuric acid, (b) mixing the acid-treated aggregate with an aqueous suspension of cereal flour, (c) mixing the product of step (b) with a core oil, (d) delivering the mixture to a core box or molding box and (e) heating to a temperature and for a period of time sufficient to polymerize the core oil.

2. The process of claim 1 wherein the acid is used in an amount of 0.005 to 5.0% based on the aggregate.

3. The process of claim 2 wherein the acid is used in an amount of 0.25 to 1.0%.

4. The process of claim 1 wherein the acid is orthophosphoric acid.

5. The process of claim 1 wherein the acid is sulfuric acid.

6. The process of claim 1 wherein the aggregate is olivine, chromite, zircon, staurolite or aluminum silicate sands.

7. The process of claim 1 wherein the aggregate is olivine sand.

* * * * *